US006148804A

United States Patent [19]

Blomquist et al.

[11] Patent Number: 6,148,804

[45] Date of Patent: Nov. 21, 2000

[54] DUTY CYCLING FEATURE FOR THE PROPORTIONAL PURGE SOLENOID TO IMPROVE LOW FLOW RESOLUTION

[75] Inventors: William B. Blomquist, Lake Orion; Sandra N. Thomson, Rochester Hills; Patrick T. McCourt, Auburn Hills; Yi Cheng, Jackson, all of Mich.

[73] Assignee: DaimlerChrysler Corporation, Auburn Hills, Mich.

[21] Appl. No.: 09/447,136

[22] Filed: Nov. 22, 1999

[51] Int. Cl.[7] ..... F02M 37/04

[52] U.S. Cl. ..... 123/520; 123/458; 361/153

[58] Field of Search ..... 123/520, 521, 123/519, 518, 516, 458; 361/153, 152

[56] References Cited

U.S. PATENT DOCUMENTS

| | | | |
|---|---|---|---|
| 4,631,627 | 12/1986 | Morgan | 361/153 |
| 5,206,540 | 4/1993 | Silva | 361/153 |
| 5,413,082 | 5/1995 | Cook | 123/458 |
| 5,495,749 | 3/1996 | Dawson et al. . | |
| 5,606,121 | 2/1997 | Blomquist et al. . | |
| 5,616,836 | 4/1997 | Blomquist et al. . | |
| 5,635,630 | 6/1997 | Dawson et al. . | |
| 5,641,899 | 6/1997 | Blomquist et al. . | |
| 5,651,350 | 7/1997 | Blomquist et al. . | |
| 5,685,279 | 11/1997 | Blomquist et al. . | |
| 5,690,083 | 11/1997 | Gopp | 361/153 |
| 5,715,799 | 2/1998 | Blomquist et al. . | |
| 5,727,532 | 3/1998 | Everingham | 123/458 |
| 5,835,330 | 11/1998 | Kirschner | 361/152 |
| 5,873,350 | 2/1999 | Wild | 123/458 |
| 5,915,667 | 6/1999 | Kim | 361/152 |
| 5,921,224 | 7/1999 | Sinnamon | 361/153 |
| 5,933,313 | 8/1999 | Furukawa | 361/152 |

*Primary Examiner*—Carl S. Miller
*Attorney, Agent, or Firm*—Mark P. Calcaterra

[57] ABSTRACT

A method of controlling a proportional purge solenoid is provided to improve low flow resolution. The method includes looking-up a primary duty cycle corresponding to purge current in a three-dimensional surface by using purge flow and vacuum level as inputs. Should the primary duty cycle fall below a lowest allowable purge current threshold value, a secondary purge duty cycle (i.e., an on/off pattern of the primary duty cycle) is obtained from a two-dimensional table by using the actual calculated purge flow as an input. The two-dimensional table includes a sequence of program loops subdivided into a delay region wherein the purge flow and vacuum level data are learned, an updating region wherein the purge current of the three-dimensional surface is updated, and a control region wherein the primary duty cycle is toggled between on and off states. When the current program loop falls within the delay region, a recorded primary duty cycle is output. When the current program loop falls within the updating region, the primary duty cycle is applied at a time determined during the last program sequence. When the current program loop falls within the control period, the primary duty cycle is applied at a time when the current program loop number equals a program loop number of the two-dimensional surface corresponding to the actual calculated purge flow.

8 Claims, 3 Drawing Sheets

DUTY CYCLING FEATURE FOR THE PROPORTIONAL PURGE SOLENOID TO IMPROVE LOW FLOW RESOLUTION

BACKGROUND OF THE INVENTION

1. Technical Field

The present invention generally relates to evaporative emission control systems for automotive vehicles and, more particularly, to a method of controlling the proportional purge solenoid of an evaporative emission control system of an automotive vehicle.

2. Discussion

Automotive vehicles typically include a fuel tank for storing fuel and an evaporative emission control system for collecting volatile fuel vapors generated in the fuel tank. The evaporative emission control system includes a vapor collection canister, usually containing an activated charcoal mixture, to collect and store the fuel vapors. Normally, the vapor collection canister collects fuel vapors which accumulate during re-fueling of the automotive vehicle or from increases in fuel temperature. However, when conditions are conducive to purging the fuel vapors from the collection canister, a purge valve between an intake manifold of the vehicle's engine and the canister is opened by an amount determined by the engine control unit to purge the canister. Thereafter, the stored vapors are drawn into the intake manifold from the canister for ultimate combustion within a combustion chamber of the engine.

The amount the purge valve is opened is controlled by the amount of current delivered thereto. At low intake air flow levels and intake vacuum, the amount the purge valve should be opened may require a current to be delivered which is below a minimum threshold current level. As such, the purge valve receives either no current such that it remains closed when optimally it would be open for purging, or receives the minimum allowable current such that the purge valve is open more than an optimum amount. In either case, less than optimum control of the purge vapor flow through the purge valve results. In view of the foregoing, it would be desirable to provide an improved method of controlling the low-end flow characteristics of a purge valve such that enhanced control of purge flow rates through the purge valve at low intake air flow levels is provided.

SUMMARY OF THE INVENTION

It is, therefore, one object of the present invention to provide a method of controlling a purge valve of an evaporative emission control system of an automotive vehicle.

It is another object of the present invention to provide a method of controlling a purge valve at low intake air flow levels for an evaporative emission control system.

To achieve the foregoing objects, the present invention includes a method of controlling a proportional purge solenoid (i.e., purge valve) to improve low intake air flow resolution. The method includes looking-up a desired purge current from a three-dimensional surface by using purge flow and intake vacuum as inputs. A primary duty cycle is then selected to drive the purge valve at the purge current obtained from the three-dimensional surface. A lowest allowable purge current threshold is established along the surface below which the primary duty cycle may not proceed. If an optimum desired purge current falls below the lowest allowable purge current threshold, a secondary purge duty cycle is used to toggle the on/off pattern of the primary duty cycle. As such, the secondary purge duty cycle toggles the primary duty cycle's delivery of the lowest allowable purge current to the purge valve. As a result, the engine control unit delivers a lower purge vapor flow rate through the purge valve than the rate at which the minimum allowable purge current could otherwise provide.

As a further feature of the present invention, the secondary duty cycle is obtained from a two-dimensional table using an actual calculated purge flow value (which is a value that would correspond to a purge current less than the lowest allowable purge current) as an input. The table includes a delay region where a recorded primary duty cycle is applied, an updating region where the primary duty cycle is applied at a time determined during a previous program sequence, and a control region where the primary duty cycle is applied for as much time as is needed to deliver the purge current to yield the desired purge flow. A proportional-integral-derivative calculation is performed to determine when the primary duty cycle should send the purge current to the purge valve, i.e., to determine the actual purge flow value. When the primary duty cycle is applied from the engine control unit according to the secondary duty cycle schedule, the lowest allowable current from the three dimensional surface is intermittently delivered to the purge valve.

One advantage of the present invention is that a method is provided for controlling a proportional purge solenoid in an evaporative emission control system of an automotive vehicle.

Another advantage of the present invention is that the method provides for enhanced control of purge flow rates from the proportional purge solenoid at lower requested purge flow levels.

Other objects, features, and advantages of the present invention will be readily appreciated as the same becomes better understood after reading the subsequent description taken in conjunction with the accompanying drawings.

DETAILED DESCRIPTION OF THE PREFERRED EMBODIMENTS

The present invention is directed towards a method of controlling a purge valve in an evaporative emission control system of an automotive vehicle. The method is based on the principle of employing a secondary duty cycle to control the on and off state of the primary duty cycle supplying current to the proportional purge solenoid. This permits the proportional purge solenoid to be scheduled all the way down to a fraction of the flow that would otherwise be achieved. As such, a significant improvement is realized in the lower end flow control and range of authority on solenoid devices.

Figure 1:
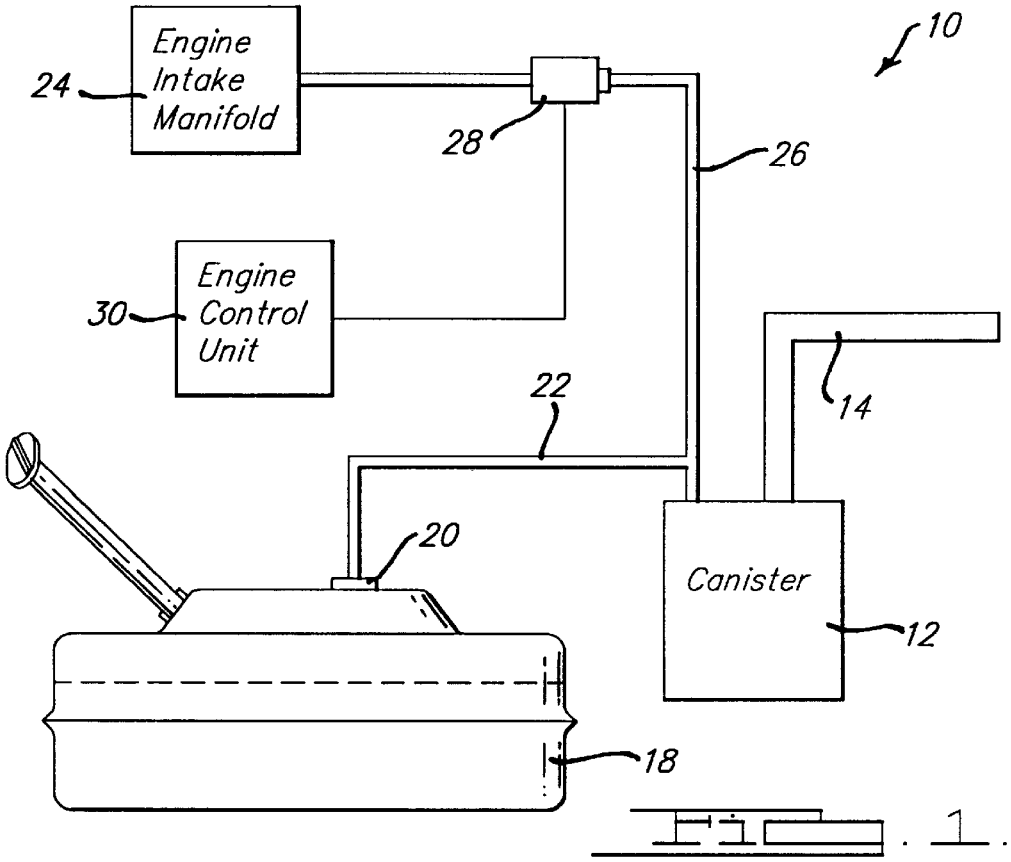
FIG. 1 is a schematic diagram of an evaporative emission control system according to the present invention.

Turning now to the drawing figures, FIG. 1 illustrates an evaporative emission control system 10 for an automotive vehicle according to the present invention. The control system 10 includes a carbon canister 12 having a conduit 14 coupled thereto and communicating with the atmosphere. A fuel tank 18 is connected to the carbon canister 12 by a conduit 22. It should be appreciated that this is merely a representative example of several possible means by which the fuel tank 18 may be connected to the carbon canister 12.

An intake manifold 24 is connected to the carbon canister 12 by a conduit 26. A proportional purge solenoid 28 is mounted along the conduit 26. An engine control unit 30 is connected to and operative to control the proportional purge solenoid 28.

In operation, a supply of liquid fuel for powering an engine of the automotive vehicle is placed in the fuel tank 18. As fuel is pumped into the tank 18 or as the temperature of the fuel increases, vapors from the fuel pass through the conduit 22 and are received in the canister 12. Normally, the proportional purge solenoid 28 is closed. However, under certain vehicle operating conditions conducive to purging, the engine control unit 30 opens the proportional purge solenoid 28 such that a certain amount of engine intake vacuum is placed on the canister 12. In response, the collected vapors flow from the canister 12 through the conduit 26 and the proportional purge solenoid 28 to the intake manifold 24. From the intake manifold 24, the vapors are combusted within the engine.

Figure 2:
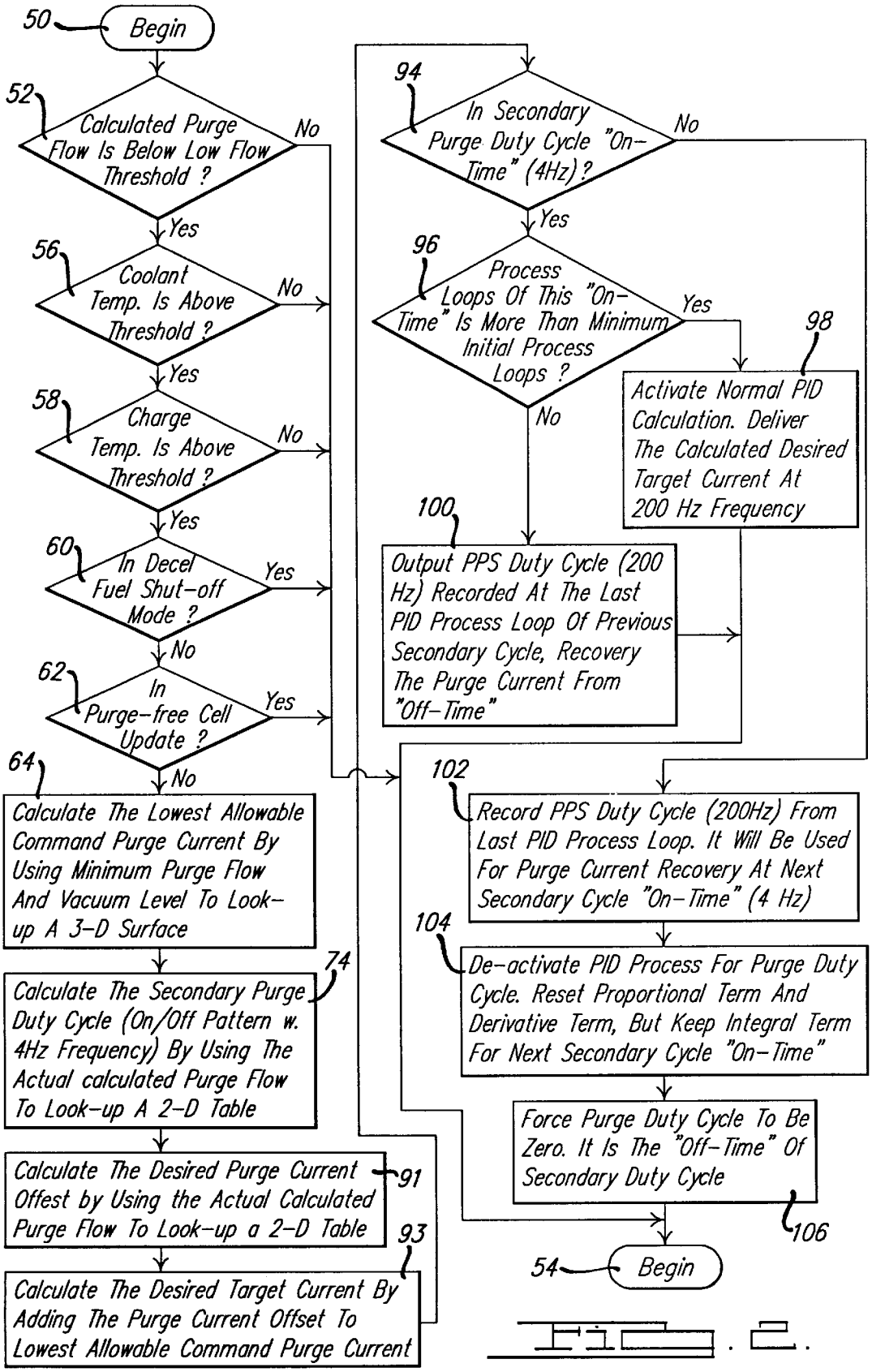
FIG. 2 is a flowchart of a method of controlling the purge valve of the evaporative emission control system illustrated in FIG. 1 according to the present invention.

Turning now to FIG. 2, a method of controlling the proportional purge solenoid 28 of FIG. 1 is illustrated.

The solenoid is opened to various degrees by controlling the current delivered thereto. The current is controlled by a primary duty cycle. If a current is required which is less than the lowest amount deliverable, a secondary duty cycle is used to control the primary duty cycle. In this way, the lowest deliverable current is delivered periodically thereby achieving the same result with the solenoid as with a lower current.

The methodology starts in block 50 and falls through to decision block 52. In decision block 52, the methodology determines if a calculated valve of purge flow desired through the solenoid is below a low purge flow threshold value. That is, the methodology determines if the desired purge flow through the proportional purge solenoid is less than a purge flow limit corresponding to the lowest flow the solenoid would normally allow. Purge flow rates less than the threshold would require a purge current to operate the proportional purge solenoid which is below the lowest allowable current threshold.

Thus, if the desired purge flow is greater than or equal to the low purge flow threshold at decision block 52, normal solenoid control is possible. Therefore, a purge current may be selected directly from a three dimensional surface having purge flow and intake vacuum as inputs (see FIG. 3). The selected current may then be immediately applied to the proportional purge solenoid without additional processing. Accordingly, if the desired purge flow is greater than or equal to the low purge flow threshold at decision block 52, the methodology advances to block 54 and exits the subroutine pending a subsequent execution thereof. For example, the subroutine program loop could be executed every 12 to 13 ms.

On the other hand, if the calculated purge flow is less than the low purge flow threshold at decision block 52, the required purge current for operating the solenoid according to the purge flow and intake vacuum level is lower than the lowest allowable purge current. As such, special control is employed. That is, a secondary duty cycle is applied to the primary duty cycle to control the current delivered to the purge solenoid. This yields the effect of a purge current which is lower than the lowest allowable purge current without actually dropping the delivered current below the lowest allowable purge current level.

The first step of this special control is to ensure that certain enable criteria are satisfied. Accordingly, if the calculated purge flow is less than the low purge flow threshold at decision block 52, the methodology advances to decision block 56. In decision block 56, the methodology determines if the coolant temperature is above a coolant temperature threshold. The coolant temperature threshold is established to ensure that present operating conditions merit special solenoid control. Coolant temperatures below the threshold will not permit activation. Therefore, if the coolant temperature is less than or equal to the coolant temperature threshold at decision block 56, the methodology advances to block 54 and exits the subroutine. However, if the coolant temperature is greater than the coolant temperature threshold at decision block 56, the methodology advances to decision block 58.

In decision block 58, the methodology determines if the charge air temperature is above a charge air temperature threshold. The charge air temperature threshold is established to ensure conditions merit special solenoid control. A charge air temperature below the charge air temperature threshold will not enable the special control. Therefore, if the charge air temperature is less than or equal to the charge air temperature threshold at decision block 58, the methodology advances to block 54 and exits the subroutine. However, if the charge air temperature is greater than the charge air temperature threshold at decision block 58, the methodology advances to decision block 60.

In decision block 60, the methodology determines if the vehicle engine is in a deceleration fuel shut off mode. This determination is made to inhibit special control at certain times. Therefore, if the vehicle engine is in a deceleration fuel shut off mode at decision block 60, the methodology advances to block 54 and exits the subroutine. However, if the vehicle engine is not in a deceleration fuel shut off mode at decision block 60, the methodology advances to decision block 62.

In block 62, the methodology determines if the vehicle engine control unit is in a purge-free cell update mode. This determination is made because the engine control unit is unavailable for controlling the proportional purge solenoid of the evaporative emission control system during a purge-free cell update. Therefore, if the vehicle engine control unit is in a purge-free cell update at decision block 62, the methodology advances to block 54 and exits the subroutine. However, if the vehicle engine control unit is not in a purge-free cell update mode at decision block 62, the methodology advances to block 64.

Figure 3:
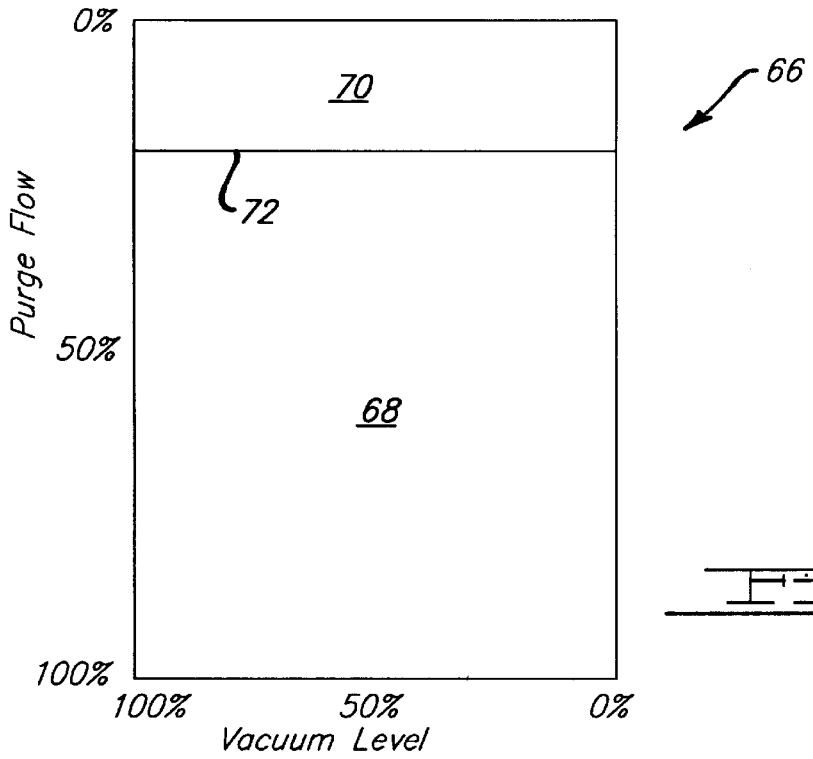
FIG. 3 is a graphical representation of a three-dimensional surface employed by the method of FIG.2.

By arriving in block 64, all prerequisite criteria have been satisfied. Further, from decision block 52, a purge flow is being requested which is below the low flow threshold. Thus, in block 64, the engine control unit commands the methodology to look up the lowest allowable commanded purge current from a three-dimensional surface by using minimum purge flow and vacuum level as inputs. Referring momentarily to FIG. 3, an exemplary three-dimensional surface for use in conjunction with block 64 is illustrated. The three-dimensional surface 66 includes a normal flow region 68 and a low purge flow region 70. A line 72 transcending the surface 66 depicts the lowest allowable purge flow value and therefore a lowest allowable purge current. The low flow threshold referred to in decision block 52 is equal to the minimum purge flow value 72.

The normal flow region 68 is accessed when the calculated purge flow is greater than or equal to the low purge flow threshold at decision block 52 of FIG. 2. When the normal flow region 68 is accessed, the engine controller delivers a purge current from the surface 66 to the purge valve in the form of a percentage of primary duty cycle. Depending on the purge flow and vacuum levels, between 100% primary duty cycle (along the x-axis) and about 20% primary duty cycle (along the line 72) is delivered to the proportional purge solenoid. As such, the purge valve opens a certain extent to control the flow rate of purge vapors passing therethrough.

On the other hand, the low purge region 70 is accessed when the calculated purge flow is less than the low purge flow threshold at decision block 52 of FIG. 2. In region 70, the desired flow through the proportional purge solenoid is less than the minimum purge flow value 72 (i.e., the purge flow and vacuum levels call for an output from region 70). As such, a secondary purge duty cycle is used to toggle the primary duty cycle delivered to the purge valve between on and off states. In other words (and as described in greater below), when the purge flow and vacuum level cause a purge current to be called for from region 70, the minimum purge flow value 72 is periodically delivered to the purge valve according to a secondary duty cycle.

Referring again to FIG. 2, after looking up the lowest allowable commanded purge current by using minimum purge flow and vacuum level on the three-dimensional surface at block 64, the methodology continues to block 74. In block 74, the secondary purge duty cycle (i.e., the on/off pattern of the primary duty cycle delivering its lowest allowable purge current) is obtained from a two-dimensional table by using the actual calculated desired purge flow value, even if that value is below the lowest allowable purge flow, as an input.

Figure 4:
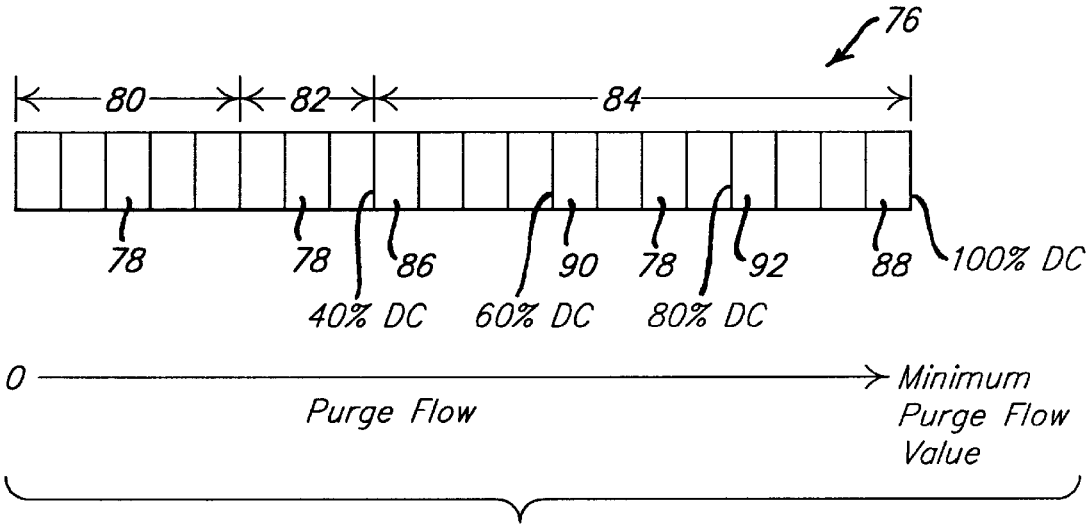
FIG. 4 is a graphical depiction of a two-dimensional table employed by the method of FIG. 2.

Referring momentarily to FIG. 4, an exemplary two-dimensional table 76 for obtaining the secondary duty cycle is illustrated for use in conjunction with block 74. The two-dimensional table 76 includes a number of cells each representing one program loop 78 of the methodology depicted in FIG. 2. The table 76 of program loops 78 is referred to sometimes hereinafter as one "event". It should be noted that an "event" as used herein means a sequence of a preselected number of program loops 78 (such as twenty) wherein the primary duty cycle may be commanded to be entirely on, entirely off, or partly on and partly off. The two-dimensional table 76 is accessed by the actual calculated desired purge flow which serves as a pointer for indicating which program loop 78 of the sequence the primary duty cycle should be turned on. That is, the methodology tracks what program loop 78 out of the twenty loop event it is on and then compares it to the calculated purge flow indicated program loop within the table 76 to determine if it should apply the primary duty cycle to the purge valve or if it should not. The program loop counter is restarted after each event (every twenty loops).

The program loops 78 of table 76 are grouped into three regions including a delay region 80, an updating region 82, and a control region 84. The delay region 80 encompasses the minimum number of program loops 78 required for the methodology to learn the purge flow and intake vacuum level data required to determine the desired on/off pattern (i.e., secondary duty cycle) of the primary duty cycle. That is, the delay region 80 allows a current sensing circuit of the evaporative emission control system to fully update. Since the data during this learning period is deemed unreliable, the methodology outputs the level of primary duty cycle recorded during the last event. Thus, although the proportional-integral-derivative calculation feature of the present invention, which normally determines the level of primary duty cycle to use, is active during the delay period 80, its result is not applied. Therefore, the recorded primary duty cycle is output during each program loop of delay region 80.

After learning the purge flow and vacuum levels during the delay region 80, the next set of program loops 78 form the updating region 82. The updating region 82 encompasses the minimum number of program loops required to update the purge current from the three-dimensional surface 66 of FIG. 3. That is, in region 82 the current sensing circuit of the evaporative emission control system is updated and, therefore, the purge flow and vacuum level data required to determine the secondary duty cycle is available. As such, the level of primary duty cycle output by the methodology in region 82 may be adjusted according to the learned data. Thus, the proportional-integral-derivative determined updated primary duty cycle is output during each program loop of the region 82.

After updating the required current during the updating region 82, the next series of program loops 78 form the control region 84 wherein the primary duty cycle continues to be updated but may eventually be turned off. That is, the control region 84 encompasses a number of program loops 78 wherein the primary purge duty cycle may be turned off to effectuate the secondary duty cycle. As described above, depending on the calculated desired purge flow through the proportional purge solenoid, one of the program loops 78 within the control region 84 will be indicated. When the current program loop number equals the indicated program loop 78, the application of the primary duty cycle is removed from the purge valve. Depending upon which program loop the primary duty cycle is removed, different secondary duty cycles are effectuated.

Thus, the primary duty cycle can be operated fully on wherein the lowest allowable current is continuously applied to the purge valve for all twenty program loops of table 76 such that 100% secondary purge duty cycle is applied, operated fully off wherein a record current or zero current is applied to the purge valve for all twenty program loops such that 0% secondary duty cycle is applied, or operated on for part of the twenty program loops and then operated off for the remainder of the program loops such that a percentage of secondary duty cycle is applied. It should be noted that while the secondary duty cycle calls for the primary duty cycle to be on, the primary duty cycle delivers the minimum purge flow value (i.e., the lowest allowable current) to the purge valve. When the primary duty cycle is turned off, its value is recorded such that it may be applied at the beginning of the next event (i.e., at the first program loop 78 of region 80).

The program loop number when the primary duty cycle is turned off determines the percentage of secondary duty cycle applied. That is, if the primary duty cycle is commanded to be on for the first ten program loops and then off for the remainder, 50% secondary duty cycle has been applied. Thus, the primary duty cycle is toggled between an on time for a number of program loops along the two-dimensional table 76 and an off time for the remainder of the program loops 78 of the two-dimensional table 76 according to the desired purge flow through the purge valve.

If the desired purge flow corresponds to a secondary duty cycle of 40%, each of the first eight program loops 78 of the two-dimensional table 76 will call for delivery of the appropriate primary duty cycle (the recorded primary duty cycle in region 80 and updated primary duty cycle within the regions 82 and 84). At the ninth program loop 86, the primary duty cycle will be set to zero. Thereafter, the primary duty cycle will not be applied to the purge valve through the twentieth program loop 88. For 60% secondary duty cycle, the primary duty cycle is commanded to be on until the thirteenth program loop 90. At the thirteenth program loop 90, the primary duty cycle is set to zero and thereafter remains off until the beginning of the next event. For 80% secondary duty cycle, the primary duty cycle is on for the first sixteen program loops 78 and is turned off at the seventeenth program loop 92. It should be noted that zero percent primary duty cycle is used simply to turn off the solenoid. For instance, it is presently preferred to utilize the two-dimensional table 76 to call for between 40% and 100% primary duty cycle.

Referring again to FIG. 2, after looking up the secondary purge duty cycle in the two-dimensional table at block 74 (i.e., after determining which program loop is indicated in the series of program loop blocks for turning off the primary duty cycle), the methodology continues to block 91. In block 91, the methodology calculates a desire current offset value based on the actual calculated purge flow. At times, the actual purge flow may not equal the desired purge flow by such a small amount that duty cycle control alone will not yield enough control of the solenoid to yield the necessary correction to flow. To overcome this problem, an offset value is applied to the purge current. This results in finer control of the solenoid.

Figure 5:
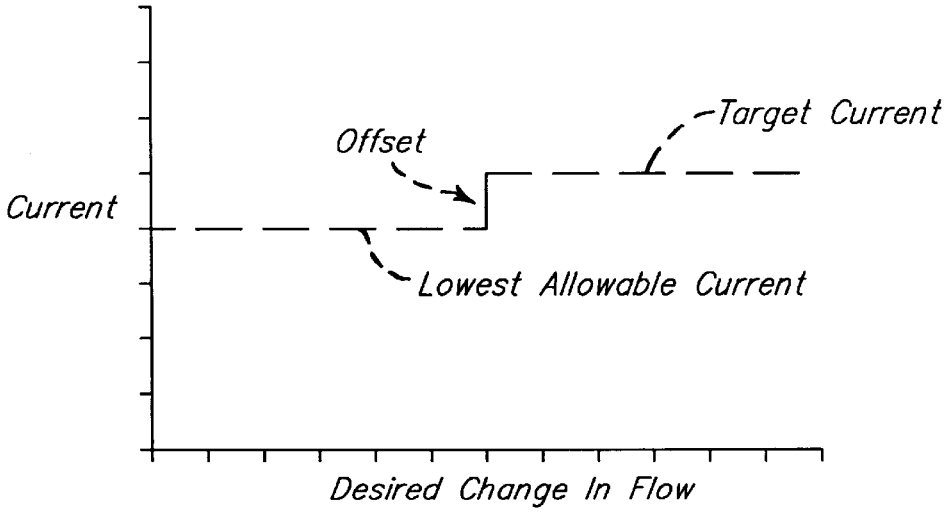

Referring momentarily to FIG. 5, the offset current value is preferably obtained from a two-dimensional table using the desired change in flow as the input. The desired change in flow is obtained by comparing the actual calculated flow to the desired flow. From this, the offset may be obtained. When applied to the purge current, the lowest allowable purge current is slightly modified by the offset current value.

Referring again to FIG. 2, after calculating the desire purge current offset at block 91, the methodology continues to block 93. In block 93, the methodology calculates the desired target current by adding the purge current offset (from block 91) to the lowest allowable command purge current (from block 64). The desired target current five times the purge flow through the solenoid. From block 93, the methodology continues to decision block 94.

In decision block 94, the methodology determines if the secondary purge duty cycle is "on". That is, the methodology compares the current program loop with the loops of the two-dimensional table 76 (FIG. 4) to determine if the primary duty cycle should be applied to the purge valve or not (i.e., is the current program loop before or after the indicated program loop for turning off the primary duty cycle). If so, the methodology advances to decision block 96.

In decision block 96, the methodology determines if the current program loop number is greater than the minimum number of delay and updating loops required for the current sensing circuit to become reliable. That is, the methodology determines if the current program loop falls within the delay region 80 or the updating region 82 of the two-dimensional table 76 illustrated in FIG. 4. If so, the methodology continues to block 98. In block 98, the methodology activates the proportional-integral-derivative calculation to determine the desired purge flow at the purge valve. If the current loop number falls within the updating region 82 of the table 76 illustrated in FIG. 4, the methodology delivers the calculated primary duty cycle to the proportional purge solenoid. However, if the current program loop falls within the delay region 80 at decision block 96, the methodology continues to block 100.

In block 100, the methodology outputs the primary duty cycle recorded at the last event. This primary duty cycle will equal the amount of any duty cycle determined by the last proportional-integral-derivative calculation prior to the primary duty cycle being turned off. Thus, at block 100 the last purge current calculated at block 98 is utilized. From block 100, as well as from block 98, the methodology continues to block 54 and exits the subroutine.

Referring again to decision block 94, if the secondary purge duty cycle is "off" (i.e., the current program loop falls within the control region 84 of the two-dimensional table 76 illustrated in FIG. 4, after the indicated program loop block), the methodology advances to block 102. In block 102, the proportional purge solenoid's present primary duty cycle is recorded from the last proportional-integral-derivative calculating process loop (i.e., block 98). This value is used for purge current recovery at the beginning of the next secondary duty cycle event (i.e., in delay region 80). From block 102, the methodology continues to block 104.

In block 104, the methodology deactivates the proportional-integral-derivative calculating process for determining purge duty cycle. This is accomplished by resetting the proportional and derivative terms but keeping the integral term for the next secondary duty cycle event on time (i.e., delay region 80). From block 104, the methodology continues to block 106. In block 106, the primary duty cycle is turned off by setting the primary duty cycle to zero. As can be appreciated, the time when the primary duty cycle is turned off is dictated by the secondary duty cycle (i.e., how many program loops are "on" and how many program loops are "off"). From block 106, the methodology advances to block 54 and exits the subroutine.

Thus, the present invention recognizes that at most purge flow and vacuum level conditions, the current delivered from a three-dimensional surface for operating a purge valve is acceptable. Therefore, a primary duty cycle may be selected from the three-dimensional surface for controlling the purge flow through the proportional purge solenoid. However, at certain purge flow conditions and vacuum levels, the data for accessing such a three-dimensional table is somewhat unreliable. For optimizing control under these conditions, the lowest allowable primary duty cycle is output periodically to the purge valve through use of a secondary duty cycle. More particularly, the actual purge current corresponding to such low purge flow conditions and vacuum levels is used to determine a secondary duty cycle for switching the primary duty cycle between on and off states. By utilizing a secondary duty cycle, the primary duty cycle is intermittently delivered to the proportional purge solenoid at its lowest reliable current. As such, the proportional purge solenoid is operated at a lower flow rate than would otherwise be possible. To fine-tune the proportional purge solenoid, a current offset value may be applied based on the difference between desired purge flow and actual purge flow.

Those skilled in the art can now appreciate from the foregoing description that the broad teachings of the present invention can be implemented in a variety of forms. For example, the primary and secondary duty cycles may have frequencies other than 200 and 4 Hz as presently preferred. Also, the number of program loop blocks comprising the two-dimensional table and the distribution thereof in each of the delay, updating and control regions may be varied according to system capabilities and therefore the 20 block event with a 5 block delay region, 3 block updating region and 12 block control region is merely exemplary. Therefore, while this invention has been described in connection with particular examples thereof, the true scope of the invention should not be so limited since other modifications will become apparent to the skilled practitioner upon a study of the drawings, specification, and following claims.

What is claimed is:

1. A method of controlling a purge solenoid in an evaporative emission control system of an automotive vehicle comprising:

determining if a desired purge flow through said purge solenoid is below a predetermined purge threshold;

looking up a minimum purge current from a three-dimensional table using minimum purge flow and vacuum level as inputs if said desired purge flow is below said purge threshold;

looking up a secondary purge duty cycle from a two-dimensional table using said desired purge flow as an input;

determining if a current state of said secondary purge duty cycle is in a delay mode, updating mode, or control mode;

delivering a primary duty cycle to said purge solenoid corresponding to said minimum purge current at a previously determined primary duty cycle value if said secondary purge duty cycle is in said delay mode;

delivering said primary duty cycle to said purge solenoid corresponding to said minimum purge current at a currently calculated primary duty cycle value if said secondary purge duty cycle is in said updating mode;

delivering said primary duty cycle to said purge solenoid corresponding to said minimum purge current at a currently calculated primary purge duty cycle value if said secondary purge duty cycle is in said control mode and said secondary duty cycle is on; and forcing said primary duty cycle delivered to said purge solenoid corresponding to said minimum purge current to zero if said secondary purge duty cycle is in said control mode and said secondary duty cycle is off.

2. The method of claim 1 wherein said previously determined primary duty cycle value is equal to a last calculated primary duty cycle prior to said secondary duty cycle being turned off.

3. The method of claim 1 wherein said currently calculated primary duty cycle is determined in a proportional-integral-derivative calculation.

4. The method of claim 1 further comprising recording a last currently calculated primary duty cycle value prior to said secondary duty cycle being turned off for use as said previously determined primary duty cycle.

5. The method of claim 4 further comprising determining if a coolant temperature of said automotive vehicle is greater than a coolant temperature threshold prior to looking up said minimum purge current.

6. The method of claim 4 further comprising determining if a charge air temperature of said automotive vehicle is greater than a charge air temperature threshold prior to looking up said minimum purge current.

7. The method of claim 4 further comprising determining that said automotive vehicle is not in a deceleration fuel shut-off mode prior to looking up said minimum purge current.

8. The method of claim 4 further comprising determining that said automotive vehicle is not in a purge free cell update mode prior to looking-up said minimum purge current.

* * * * *